US005731751A

United States Patent [19]

Vangala

[11] Patent Number: 5,731,751

[45] Date of Patent: Mar. 24, 1998

[54] CERAMIC WAVEGUIDE FILTER WITH STACKED RESONATORS HAVING CAPACITIVE METALLIZED RECEPTACLES

[75] Inventor: Reddy R. Vangala, Albuquerque, N. Mex.

[73] Assignee: Motorola Inc., Schaumburg, Ill.

[21] Appl. No.: 608,269

[22] Filed: Feb. 28, 1996

[51] Int. Cl.[6] ..... H01P 1/20; H01P 7/10

[52] U.S. Cl. ..... 333/212; 333/209; 333/219.1; 333/235

[58] Field of Search ..... 333/202, 208, 333/209, 212, 219.1, 222, 223, 235

[56] References Cited

U.S. PATENT DOCUMENTS

| | | | |
|---|---|---|---|
| 4,060,779 | 11/1977 | Atia et al. | 333/212 |
| 4,489,293 | 12/1984 | Fiedziuszko | 333/202 |
| 4,560,965 | 12/1985 | Gosling et al. | 333/219.1 |
| 4,568,894 | 2/1986 | Gannon et al. | 333/202 |
| 4,602,229 | 7/1986 | Yester, Jr. et al. | 333/208 |
| 4,607,242 | 8/1986 | Cozzie | 333/209 |
| 4,691,179 | 9/1987 | Blum et al. | 333/202 |
| 4,725,798 | 2/1988 | Igarashi | 333/208 X |
| 4,899,118 | 2/1990 | Polinski, Sr. | 333/246 |
| 4,963,844 | 10/1990 | Konishi et al. | 333/208 |
| 5,010,309 | 4/1991 | Manssen et al. | 333/202 X |
| 5,202,654 | 4/1993 | Heine | 333/206 |
| 5,382,931 | 1/1995 | Piloto et al. | 333/208 |
| 5,400,000 | 3/1995 | Okamura et al. | 333/175 |
| 5,557,246 | 9/1996 | Ishihara et al. | 333/222 X |

FOREIGN PATENT DOCUMENTS

| | | | |
|---|---|---|---|
| 6314915 | 11/1994 | Japan | 333/223 |

*Primary Examiner*—Robert Pascal
*Assistant Examiner*—Barbara Summons
*Attorney, Agent, or Firm*—Gary J. Cunningham; Colin M. Raufer

[57] ABSTRACT

A high frequency ceramic waveguide bandpass filter (100) having: two or more waveguide resonators (102) stacked vertically, each adjacent waveguide resonator is coupled with a shunt capacitance, and includes: a plate of dielectric material having a top planar surface (108), a bottom planar surface (110), and four side surfaces (112, 114, 116 and 118); a metallized receptacle (120) on the planar surface (108) and the bottom planar surface (110), the metallized receptacles (120) defining capacitive probes; a metallization layer on substantially all the surfaces of the resonators (102) with the exception of an unmetallized area (124, 126) surrounding the capacitive probes; and the resonators (102) having a conductive interface adapted to electrically connect to an adjacent resonator.

18 Claims, 2 Drawing Sheets

—PRIOR ART—

CERAMIC WAVEGUIDE FILTER WITH STACKED RESONATORS HAVING CAPACITIVE METALLIZED RECEPTACLES

FIELD OF THE INVENTION

This invention relates to electrical filters, and more particularly to ceramic waveguide filters with stacked resonators.

BACKGROUND OF THE INVENTION

Waveguide filters are well known for their use in various electronic and telecommunication applications. Typically, waveguide filters are used for certain base station applications and other similar uses. As is the case with traditional dielectric ceramic block filters, waveguide filters often employ solid blocks of dielectric ceramic material to filter a desired frequency response from a wide band of frequencies. Often these waveguide filters are coated with a conductive metallic material on their outer surfaces. Waveguide technology is known to provide resonators with a higher unloaded electrical Q. This results in waveguide filters which have lower insertion loss values. However, prior art waveguide filters, because of their large surface area, have not found their way into the design of portable wireless telephones. Additionally, prior art waveguide filters use an inductive interresonator coupling technique as a method for electrically coupling the resonators which is only suited to waveguide filters in which the resonators are aligned longitudinally in the block of ceramic.

FIG. 1A shows a traditional ceramic waveguide filter 50. These type of waveguide filters resonate at a predetermined frequency and have a series of longitudinally spaced resonators 52, 54 and 56 which are connected by narrower waveguide sections 58 and 60. This type of arrangement results in the filter having an electrical inductive coupling between successive resonators which is shown in the corresponding electrical schematic in FIG. 1B. The electrical schematic shown in FIG. 1B consists of an electrical input 500, and electrical output 508, as well as three resonators 502, 504, and 506. More significantly, the resonators are coupled to each other by an inductive coupling technique which is shown in the schematic as inductors 510 and 512.

A novel stacked resonator waveguide filter design which reduces the size of waveguide filters thereby allowing them to be used in portable wireless telephones and other electronic telecommunications equipment, and which provides filters with a lower electrical insertion loss than comparable dielectric ceramic combline filters, while providing shunt capacitive coupling between vertically stacked resonators, would be considered an improvement in the art.

DETAILED DESCRIPTION OF THE PREFERRED EMBODIMENT

Figure 1A:
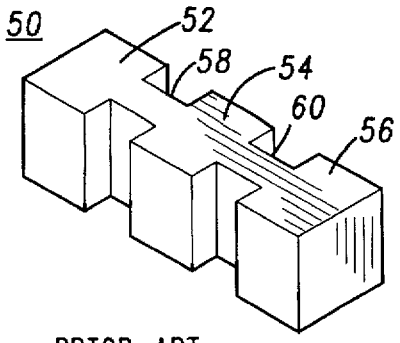
FIG. 1A shows a perspective view of a prior art waveguide filter used in the industry and FIG. 1B an accompanying electrical schematic which details the inductive coupling between the resonators.
Figure 2A:
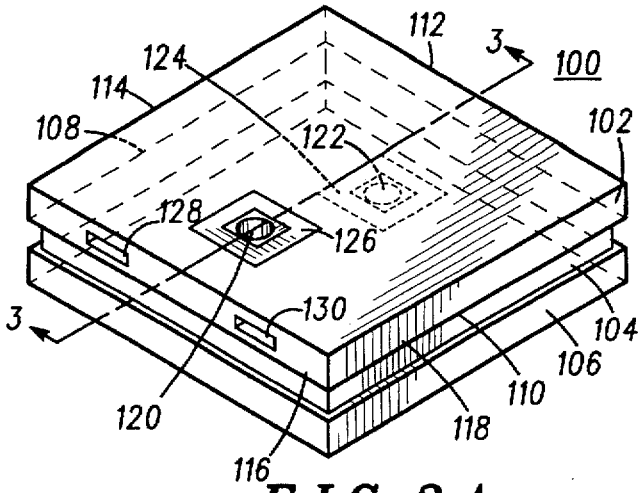
FIG. 2A shows a perspective view of a ceramic waveguide filter with stacked resonators in accordance with the present invention and FIG. 2B an accompanying electrical schematic which details the capacitive coupling between the resonators.
Figure 1B:
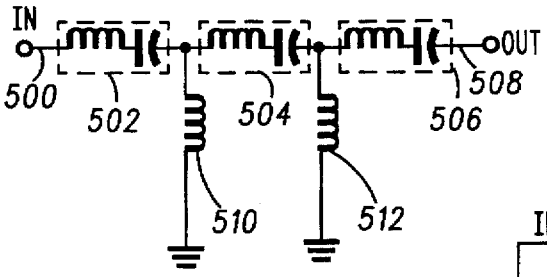
Figure 3:
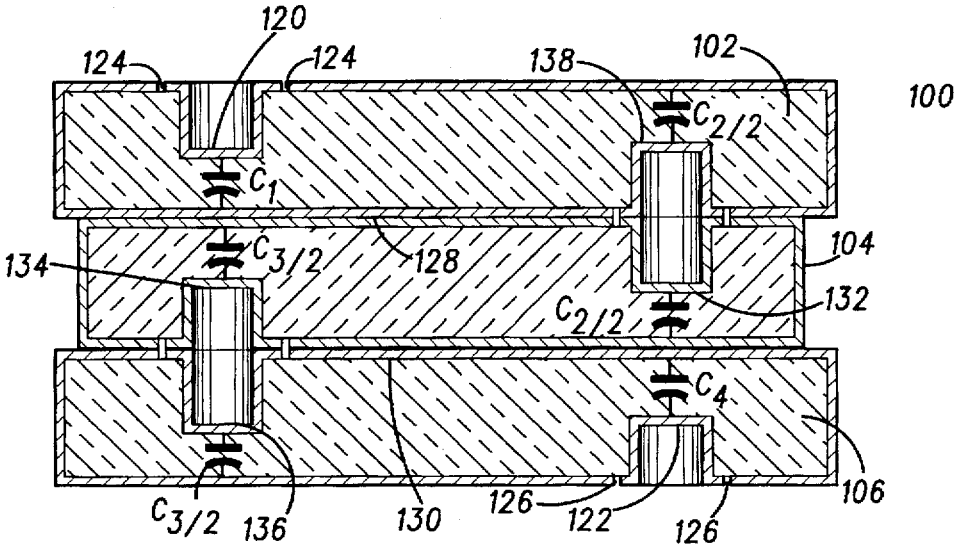
FIG. 3 shows a cross-sectional view along lines 3—3 of the filter shown in FIG. 2A, in accordance with the present invention.

FIG. 2A shows an embodiment of a high frequency ceramic waveguide bandpass filter 100 of the present invention including a plurality of waveguide resonators 102, 104, and 106. Each resonator 102, 104, 106 comprises a plate of dielectric material having a top planar surface 108, a bottom planar surface 110, and four side surfaces 112, 114, 116, and 118. This ceramic waveguide filter also has a metallized receptacle 120 on the top planar surface of the top dielectric plate 102, as well as a metallized receptacle 122 on a bottom planar surface of the bottom dielectric plate 106, the metallized receptacles defining capacitive probes, as shown in FIG. 3. Each dielectric plate can have a metallized capacitive probe on each of its top and bottom planar surfaces.

These probes are actually aligned so that successive dielectric plates can be placed on top of each other in such a way that they are also electrically capacitively coupled to each other. The internal capacitive probes and metallization layer details are shown in FIG. 3.

FIG. 3 is a cross sectional view of the filter in FIG. 2A, along lines 3—3 and is described in more detail below. Each of the resonators of the waveguide filter has a metallization layer on substantially all outer surfaces 108, 110, 112, 114, 116 and 118 (FIG. 2A), with the exception of an unmetallized area 124, 126 surrounding the capacitive probes. Since each individual dielectric plate is substantially metallized, it follows that there are metallized surfaces internal to the stacked waveguide filter. This is also shown in FIG. 3.

The vertical stacking of the resonators is an important part of this invention and is shown in FIG. 2A. By stacking resonators in this manner, there is a substantial decrease in the overall volume of the filter. More importantly, there is a decrease in the surface area required by the filter on the circuit board resulting in a smaller footprint on the board. This decreased size, in turn, allows waveguide filters to become a viable alternative to conventional combline filters in electronic applications which require small size and weight. Stacked waveguide filters have potential applications as two or three pole filters for PCS, DECT, DCS, ISM, and a variety of other applications which require signal processing.

Figure 2B:
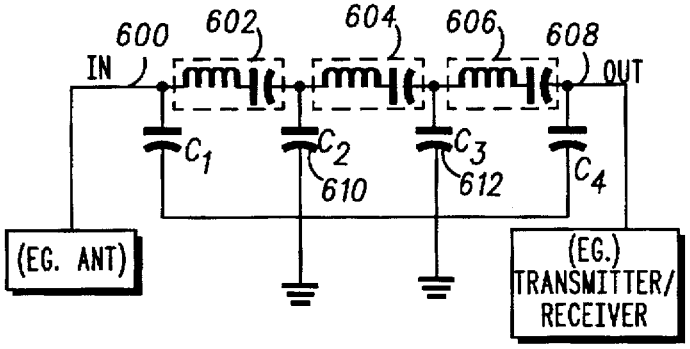

The electrical schematic shown in FIG. 2B includes an electrical input 600 and an electrical output 608 as well as three resonators 602, 604, and 606. Unlike traditional waveguide filters, the resonators in FIG. 2B are electrically coupled using a capacitive coupling technique. This is shown as a pair of shunt capacitors 610 and 612 to ground in the electrical schematic in FIG. 2B. The fact that the present invention uses a capacitive coupling technique as opposed to an inductive coupling technique, between the resonators, allows the resonators to be stacked vertically, as opposed to longitudinally, thereby reducing the surface area required on the circuit board (footprint) which is an integral part of the invention.

A means for electrically connecting the stacked resonators defining a conductive interface is shown in FIG. 3. In more detail, the three, distinct resonators 102, 104, and 106 are stacked vertically to provide a waveguide bandpass filter. The depth of the metallized receptacle on the top planar surface 120, and the depth of the metallized receptacle on the bottom planar surface 122 can be clearly viewed from this perspective. A significant feature of the present invention is the fact that all outer surfaces of each resonator are metallized with the exception of an unmetallized area 124, 126 surrounding the metallized receptacles. As can be seen from FIG. 3, dielectric plates 102, 104, and 106, which are substantially metallized, are substantially stacked atop one another. As such, a means for electrically connecting the stacked resonators at interfaces 128 and 130 is provided. These surfaces, defined as conductive interfaces are typically joined by a layer of solder material, although other means such as a conductive metallic adhesive technique could also be used. These surfaces define a ground plane.

FIG. 3 also reveals how the metallized receptacles on the top and bottom planar surfaces of the dielectric plates which form the resonators are interconnected. For example, the metallized receptacle 138 on the bottom planar surface of the top plate 102 is axially aligned with and positioned directly on top of the metallized receptacle 132 on the top planar surface of the middle dielectric plate 104. Similarly, the metallized receptacle 134 on the bottom planar surface of the middle plate 104, is axially aligned with and positioned directly on top of the metallized receptacle 136 on the top planar surface of the bottom dielectric plate 106. The capacitive probes are axially aligned between successive resonators in order to achieve the desired capacitive coupling, as shown by C1–C4 in FIGS. 2B and 3.

The metallized receptacles define capacitive probes, and serve an important function in the operation of these waveguide filters. First, the probes are employed to create a capacitive coupling between the layers of dielectric ceramic. The capacitive coupling can be controlled by controlling the size, shape, location and depth of these metallized receptacles. Various embodiments of the present invention are contemplated by modifying the shape, diameter, or depth of these capacitive probes.

Figure 5:
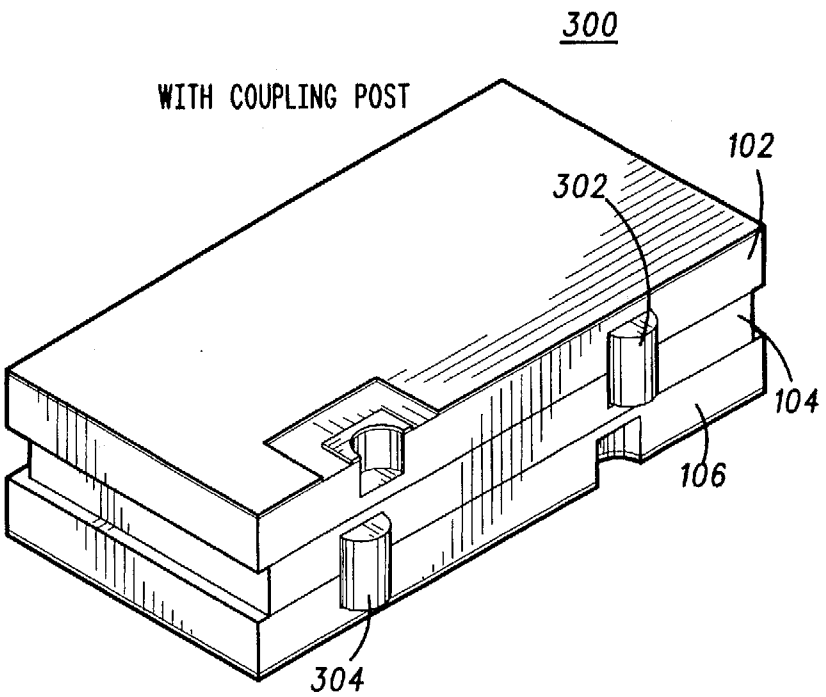
FIG. 5 shows an embodiment of the present invention in which the capacitive probes which connect the resonators are embedded with a coupling post.
Figure 4:
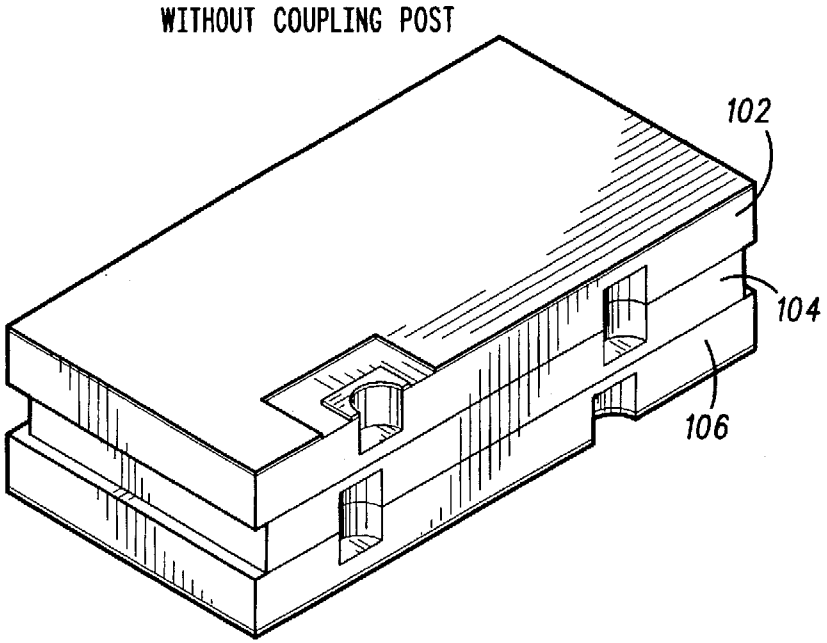
FIG. 4 shows an embodiment of the present invention in which capacitive probes which connect the resonators are without a coupling post.

FIG. 4 shows an embodiment of the present invention without a coupling post. FIG. 5 shows an embodiment of the present invention 300 with metallic coupling posts 302, 304 embedded in the waveguide ceramic filter. The posts are substantially metallic or, at a minimum, coated with a conductive material to insure conductivity. These coupling posts provide a physical connection between the resonators and are useful for alignment of the resonators during assembly.

Although the present invention contemplates the use of other positioning means between the layers of resonators, in a preferred embodiment as shown in FIG. 5, capacitive probes 302 and 304 between two layers of dielectric ceramic are shown.

The preferred coupling posts are properly metallized and electrically separated from the other metallized surfaces of the filter, and are designed so as to provide a desired coupling.

The filter 100 can be used for a wide range of frequencies. The filter 100 is particularly adapted for use in applications around 2 Giga Hertz and above because the final external dimensions of a stacked waveguide filter operating at these frequencies will be advantageous, and may be particularly preferable for use in portable wireless telecommunications equipment.

The ultimate shape of the stacked layers of dielectric is another feature, and is open to flexible design parameters. Typically, the stacked waveguide filters will be square, rectangular or substantially square and substantially rectangular in shape. This is because the dimensions of the waveguide filter itself are used to define the overall filter response curve of the filter. In fact, one design option available to radio design engineers will be to vary the dimensions of the filter in order to vary the shape of the filter's frequency response curve. For traditional filtering requirements, this can be achieved using simple square or rectangular waveguide filter designs. As should be understood by those skilled in the art, the ultimate shape of the individual resonator plates can be varied to provide a desired frequency response.

In FIG. 2A, it can been seen that the dimensions of the middle dielectric plate 104 are slightly less than the dimensions of the top plate 102 and the bottom plate 104. This is an intentional design feature which is in compliance with filter design theory. If all the dielectric plates had the exact same dimensions, the resulting filter frequency response curve could be slightly skewed. By making the middle resonator slightly smaller, a desirable frequency response curve can be obtained.

Despite the fact that the overall dimensions of the dielectric plates will determine the overall frequency response, it may prove necessary to further tune the waveguide filter by selectively removing metallization from one or more of the surfaces of the filter. In FIG. 2A, metallization may be removed from the top surface 108, the bottom surface 110, or one of the side surfaces 112, 114, 116, and 118. In a preferred embodiment, metallization will be removed from one or more of the side surfaces of the dielectric plates 102, 104, and 106 (which make up the resonators of the filter), in order to lower the frequency response of the filter. Similarly, metallization can be removed from the top and/or bottom planar surfaces in order to raise the frequency response of the filter. In FIG. 2A, two tuning (unmetallized) locations 128 and 130 are provided on side surface 116 of the top resonator 102, which, if used, would lower the frequency response of the filter.

The thickness of the dielectric plates may also be varied in order to improve the electrical performance of the filter. Typically, as the thickness of the plates is increased, the electrical Q is also increased. Whereas, in a preferred embodiment, the dielectric plates would all have the same thickness for ease of manufacturing purposes, designers may opt to make one or more of the dielectric plates thicker or thinner depending on the application. Similarly, other design parameters which can be varied include the shape, diameter, and depth of the capacitive probes.

The method for electrically coupling into and out of the waveguide filter is another parameter which can be controlled by the designer of the filter. In a preferred embodiment, a top planar surface of a top resonator will have an electrical input pad 120, and a bottom planar surface of a bottom resonator will have an electrical output pad 122 (items 600 and 608, respectively in FIG. 2B). Typically, these electrical connections will be electrically isolated from each other. The input and output pads will be isolated from each other so as to substantially prevent any type of electrical interference.

The ceramic waveguide filter 100 is particularly well suited for use in small, portable wireless telephones, and other lightweight pieces of electronic communications equipment. As such, one embodiment envisions the waveguide filter 100 being used in series between a receiver and a transmitter and/or an antenna inside a wireless telephone (see FIG. 2B). Of course, other embodiments of this invention can include use in pagers and other electronic apparatus that have filtering requirements.

The ceramic material which is used to manufacture these waveguide filters can be any one of a variety of electrical ceramic compositions. In order to achieve an acceptable size to performance ratio at 2 Giga Hertz and above, a dielectric constant (K) value of approximately 90 or above is most desirable. Thus, the waveguide filter of the present invention can be produced from most standard material compositions used in the ceramic industry.

In addition to the reduced volume waveguide filter provided, another beneficial effect of stacking the resonators is to reduce the insertion loss property of the filter. Designers are often looking for lower or improved insertion loss characteristics, because this will ultimately result in less power consumption in the wireless telephone or other telecommunication apparatus. In fact, at high frequencies, the lower insertion loss of the stacked waveguide filter can be an advantage over traditional combline filter technology.

Although various embodiments of this invention have been shown and described, it should be understood that variations, modifications and substitutions, as well as rearrangements and combinations of the preceding embodiments can be made by those skilled in the art without departing from the novel spirit and scope of this invention.

What is claimed is:

1. A high frequency ceramic waveguide bandpass filter, comprising:

a plurality of waveguide resonators that resonate in at least one of transverse electric (TE) field mode and transverse magnetic (TM) field mode and are substantially stacked vertically, each adjacent waveguide resonator is coupled with a predetermined shunt capacitance to ground:

each of the waveguide resonators further comprising:

a plate of dielectric material having a top planar surface, a bottom planar surface, and four side surfaces;

the top planar surface and the bottom planar surface having metallized receptacles defining capacitive probes, the metallized receptacles having a depth into the plate of dielectric material;

a metallization layer on substantially all the surfaces of the resonators with the exception of an unmetallized area surrounding the capacitive probes; and a conductive interface between each of the waveguide resonators.

2. The filter of claim 1, wherein each adjacent waveguide resonator is coupled via a node, and each node is coupled to ground via a shunt capacitance.

3. The filter of claim 1, wherein the capacitive probes further include metallic posts complimentarily configured to be received in at least one of the metallized receptacles.

4. The filter of claim 1, wherein substantially all the waveguide resonators have substantially similar dimensions.

5. The filter of claim 1, wherein one of the waveguide resonators has dimensions which are slightly different from the other waveguide resonators for providing a desired frequency response.

6. The filter of claim 1, wherein the metallization layer on metallization from at least one of the side surfaces, the top surface, and the bottom surface of at least one of said plurality of waveguide resonators is removed for providing a desired frequency response.

7. The filter of claim 1, wherein the ceramic waveguide filter includes a ceramic material having a dielectric constant of about 90 or above.

8. The filter of claim 1, wherein there are at least three waveguide resonator plates wherein the top planar surface of a top waveguide resonator has an electrical input pad and the bottom planar surface of a bottom waveguide resonator has an electrical output pad, and a middle waveguide resonator is located therebetween.

9. The filter of claim 1, wherein the ceramic waveguide bandpass filter is coupled in series between at least one of an antenna and a receiver and an antenna and a transmitter.

10. The filter of claim 1, wherein the ceramic waveguide bandpass filter is tuned by removing a portion of the metallization layer from one of the side surfaces of at least one of said plurality of waveguide resonators in order to lower a center frequency of the filter, and is also tuned by removing a portion of the metallization layer from one of the top planar surface and the bottom planar surface of at least one of said plurality of waveguide resonators in order to raise a center frequency of the filter.

11. The filter of claim 1, in a portable wireless telephone.

12. The filter of claim 1, which passes a predetermined range of frequencies with minimal attenuation in approximately a frequency range of about 2 Giga-Hertz and above.

13. A high frequency ceramic waveguide bandpass filter, comprising:

at least three substantially square waveguide resonators that resonate in at least one of transverse electric (TE) field mode and transverse magnetic (TM) field mode are substantially stacked vertically with a middle waveguide resonator having dimensions which are substantially slightly different from the other two waveguide resonators, each adjacent waveguide resonator is coupled with a predetermined shunt capacitance to ground:

each waveguide resonator further comprising:

a plate of dielectric material having a top planar surface, a bottom planar surface, and four side surfaces;

the top planar surface and the bottom planar surface having metallized receptacles defining capacitive probes the metallized receptacles having a depth into the plate of dielectric material;

a metallic post disposed in at least one of the metallized receptacles;

a metallization layer on substantially all of the top planar surface, the bottom planar surface, and the four side surfaces of each of the resonators defining a ground, with the exception of an unmetallized area surrounding the capacitive probes; and a conductive interface between the waveguide resonators.

14. The filter of claim 13, wherein the top planar surface of a top waveguide resonator has an electrical input pad and the bottom planar surface of a bottom waveguide resonator has an electrical output pad, and the filter passes a predetermined range of frequencies with minimal attenuation in approximately a frequency range of about 2 Giga-Hertz and above.

15. A high frequency ceramic waveguide bandpass filter, comprising:

a plurality of waveguide resonators that resonate in at least one of transverse electric (TE) field mode and transverse magnetic (TM) field mode and are substantially stacked vertically, each adjacent waveguide resonator is coupled with a predetermined shunt capacitance to ground:

each waveguide resonator further comprising:

a plate of dielectric material having a top planar surface, a bottom planar surface, and four side surfaces;

the top planar surface and the bottom planar surface having metallized receptacles defining capacitive probes, the metallized receptacles having a depth into the plate of dielectric material;

a metallic post disposed in at least one of the metallized receptacles;

a metallization layer on substantially all the surfaces of the resonators with the exception of an unmetallized area surrounding the capacitive probes; and a solder conductive interface between each of the waveguide resonators.

16. The filter of claim 15, wherein at least two of the waveguide resonators have substantially similar dimensions.

17. The filter of claim 15, wherein the top planar surface of a top waveguide resonator has an electrical input pad and the bottom planar surface of the bottom waveguide resonator has an electrical output pad, and a middle waveguide resonator is located therebetween.

18. The filter of claim 15, wherein the ceramic waveguide bandpass filter is coupled in series between at least one of an antenna and a receiver and an antenna and a transmitter.

* * * * *